US009586121B1

(12) United States Patent
Carlson et al.

(10) Patent No.: US 9,586,121 B1
(45) Date of Patent: Mar. 7, 2017

(54) ADJUSTABLE GOLF DRIVING SURFACE ASSEMBLY

(71) Applicant: Sports Complex Design Group LLC, Everett, WA (US)

(72) Inventors: James E. Carlson, Marysville, WA (US); Joseph G.C. Adams, Jr., Wenatchee, WA (US); Frederick J. Schmidt, Jr., Everett, WA (US)

(73) Assignee: Sports Complex Design Group LLC, Everett, WA (US)

( * ) Notice: Subject to any disclaimer, the term of this patent is extended or adjusted under 35 U.S.C. 154(b) by 0 days.

(21) Appl. No.: 14/545,742

(22) Filed: Jun. 11, 2015

Related U.S. Application Data

(60) Provisional application No. 61/997,897, filed on Jun. 11, 2014.

(51) Int. Cl.
*A63B 69/36* (2006.01)

(52) U.S. Cl.
CPC ..... *A63B 69/3661* (2013.01); *A63B 69/3623* (2013.01); *A63B 2208/0204* (2013.01)

(58) Field of Classification Search
CPC ..... A63B 69/0057; A63B 2225/09; A63B 69/3623; A63B 69/3652
USPC ..... 473/257, 278, 279
See application file for complete search history.

(56) References Cited

U.S. PATENT DOCUMENTS 1,594,359 A 8/1926 Estabeook
2,879,996 A 3/1959 Lederer
3,430,964 A 3/1969 Budzinski
3,633,917 A 1/1972 Anderson
3,633,918 A 1/1972 Smiley et al.
3,639,923 A 2/1972 Stewart
3,698,979 A 9/1972 Koett
3,869,127 A 3/1975 Kohori
3,869,128 A 3/1975 Ohashi
3,936,055 A * 2/1976 Scott ..... A63B 69/3652 206/315.1
4,279,420 A 7/1981 Bay et al.
4,331,332 A 5/1982 Hughes
4,779,796 A 10/1988 Lai
4,875,684 A 10/1989 Benilan
4,886,276 A 12/1989 Digangi et al.
5,004,243 A * 4/1991 Dlouhy ..... A63B 69/3661 473/279
5,308,075 A 5/1994 Theriault
5,333,876 A 8/1994 Goto
5,340,111 A * 8/1994 Froelich ..... A63B 69/3652 108/7
5,358,251 A 10/1994 Ashton
(Continued)

*Primary Examiner* — Nini Legesse
(74) *Attorney, Agent, or Firm* — Todd N. Hathaway

(57) ABSTRACT

A golf driving practice assembly having a base with a recess and an insert that is received within the recess. In a first position a driving surface for the insert extends flush with a surrounding surface of the base, and in a second position a driving surface extends at a sloped angle above the surface of the base. The insert may be invertible within the base and have the flat, flush surface on one side and the sloped, angled surface on the other. In another aspect, an adjustable support may engage an edge of the insert to raise the driving surface of the insert from the flush position to the sloped position. The adjustable support may be provided by one or more flip-up bars set within the recess.

16 Claims, 13 Drawing Sheets

(56) References Cited

U.S. PATENT DOCUMENTS

| | | | | |
|---|---|---|---|---|
| 5,431,406 | A | 7/1995 | Ishii | |
| 5,460,379 | A | 10/1995 | Cleland | |
| 5,470,074 | A | 11/1995 | Hotchkiss et al. | |
| 5,558,334 | A | 9/1996 | Roche | |
| 5,632,689 | A | 5/1997 | Duca | |
| 5,655,974 | A | 8/1997 | Bair | |
| 5,692,967 | A | 12/1997 | Guyer | |
| 5,720,670 | A | 2/1998 | Oxley et al. | |
| 5,820,478 | A | 10/1998 | Wood et al. | |
| 6,033,317 | A | 3/2000 | Beam | |
| D443,909 | S | 6/2001 | Miraflor | |
| 6,312,345 | B1 | 11/2001 | Pelz | |
| 6,623,373 | B2 | 9/2003 | Carlton et al. | |
| 6,663,498 | B2 | 12/2003 | Stipan | |
| 6,902,494 | B1 | 6/2005 | Frishberg | |
| 6,921,342 | B2 | 7/2005 | Jong | |
| D557,366 | S | 12/2007 | Witt et al. | |
| 7,758,444 | B2 | 7/2010 | Crossley | |
| 8,187,122 | B2 * | 5/2012 | Brekke | A63B 53/00 473/219 |
| 8,496,538 | B1 | 7/2013 | Tyler | |
| 8,545,341 | B2 | 10/2013 | Choi | |
| 8,911,300 | B1 * | 12/2014 | Alvarado | A63B 69/3661 473/262 |
| 2002/0187848 | A1 | 12/2002 | Tomczyk | |

* cited by examiner

ADJUSTABLE GOLF DRIVING SURFACE ASSEMBLY

RELATED CASES

This application claims the benefit of Provisional Patent Application Ser. No. 61/997,897 filed Jun. 11, 2014.

BACKGROUND a. Field of the Invention

The present invention relates generally to facilities for practicing and playing golf, and, more particularly, to an apparatus that provides an adjustable surface for practicing driving at such a facility.

b. Related Art

With respect to the game of golf, the term "driving" generally refers to forcefully hitting the ball a significant distance, for example from the tee or fairway using a wood or an iron as the club, as opposed to putting on a green. Being able to make a proper drive—without errors such as "slicing," "hooking," "topping," and so on—requires not inconsiderable skill, which in turn requires significant practice. For this purpose driving ranges are provided at many golf courses and also at stand-alone facilities, where golfers can hone their skills by making multiple drives without having to play on an actual course.

Typically, a driving range includes one or more stations set behind a line, from which the golfers can drive the balls into an open area. In some instances these stations are merely areas of dirt or turf, but less primitive facilities commonly provide a series of stalls or "boxes" having walls to protect adjoining golfers, often under a roof to allow practice to continue during inclement weather. Natural turf will not withstand repeated use in such an environment, consequently mats of synthetic turf are typically installed in the driving areas, often on top of a concrete slab.

Although widespread, conventional driving range installations exhibit several significant deficiencies. First, although much more durable than natural turf, synthetic turf nevertheless wears fairly rapidly when subjected to the concentrated impacts and scuffing inherent in driving practice, and replacement normally involves a tedious, labor-intensive process of pulling up the worn turf and then installing a fresh layer, often using an adhesive. Also, any particular synthetic turf offers the golfer the ability to practice on only a single type of surface, whereas on an actual course different types of surfaces may be encountered, such as lower grass on fairways and taller grass or dirt in the rough, for example.

Yet another limitation of conventional practice driving ranges is that the driving area surfaces are generally horizontal, whereas apart from designated tee areas the surfaces of a real course are generally sloped. In other words, much or most of the driving on an actual course is done on sloped surfaces, which cannot be practiced on the flat, horizontal surfaces of most driving ranges. A number of devices with tiltable/adjustable driving platforms have been proposed or developed, however as a group such devices have employed linkages, drive mechanism, and so on that render them too complex, expensive, cumbersome and/or unreliable for use at normal driving ranges. In some other instances permanently angled platforms have been provided or constructed, which in addition to other disadvantages offer little or no flexibility and are therefore of relative little use, while at the same time occupying valuable frontage of the range.

Accordingly, there exists a need for an apparatus for golf driving practice that permits synthetic turf or other surface material to be replaced conveniently and efficiently when worn. Furthermore, there exists a need for such an apparatus that permits practice to be performed on different types of surfaces. Still further, there exists a need for such an apparatus that permits driving practice to be performed on a sloped surface in a convenient and realistic manner. Still further, there exists a need for such an apparatus that is durable and economically practical for installation at driving ranges having multiple practice stations.

SUMMARY OF THE INVENTION

The present invention addresses the problems cited above, and provides a practice driving assembly having a recess formed within a base and an insert with a driving surface that is removably received within the recess.

The insert may comprise a generally flat surface that extends horizontally when disposed upwardly with the insert set in the recess. The base may comprise an upper surface that lies generally level and flush with the flat surface of the insert member. The insert member may further comprise a raised surface that extends above the surface of the base when the insert is inverted within the recess so that the raised surface is disposed upwardly. The raised surface of the insert may be an angled surface. The recess may comprise a shoulder that supports a lip of the insert with the insert set within the recess with either surface disposed upwardly.

The insert may comprise a replaceable layer of synthetic turf material mounted on one or both of the flat and raised surfaces. The base may comprise a base member having the recess formed in an upper side thereof. The base member may comprise a shell formed of a top panel and a tray that receives the top panel. The top panel and tray may be formed of a molded plastic sheet material. The cavity between the top panel and tray may be filled with a foam material. The insert may comprise an insert member having an outer edge that fits closely within an edge of the recess in the base. The insert member may comprise a shell formed of a first panel having the flat surface formed thereon and a second panel having the raised surface formed thereon. The cavity between the first and second panels of the insert may be filled with a foam material.

The assembly may further comprise a height adjustment mechanism that is operable to vary a pitch of the insert member. The adjustment mechanism may comprise at least one bar member that is pivotably mounted to the base member so that the bar may be flipped to a raised position in which the bar supports a lip of the insert member at a raised elevation. The bar member may comprise a U-shaped bar member having first and second legs that are pivotably mounted to the base member and a horizontal upper surface that supports the lip of the insert member. The at least one bar member may comprise a plurality of bar members having different heights. The bar members may nest within one another when folded down to the bottom of the recess.

These and other features and advantages of the present invention will be more fully appreciated from a reading of the following detailed description with reference to the accompanying drawings.

DETAILED DESCRIPTION

Figure 1:
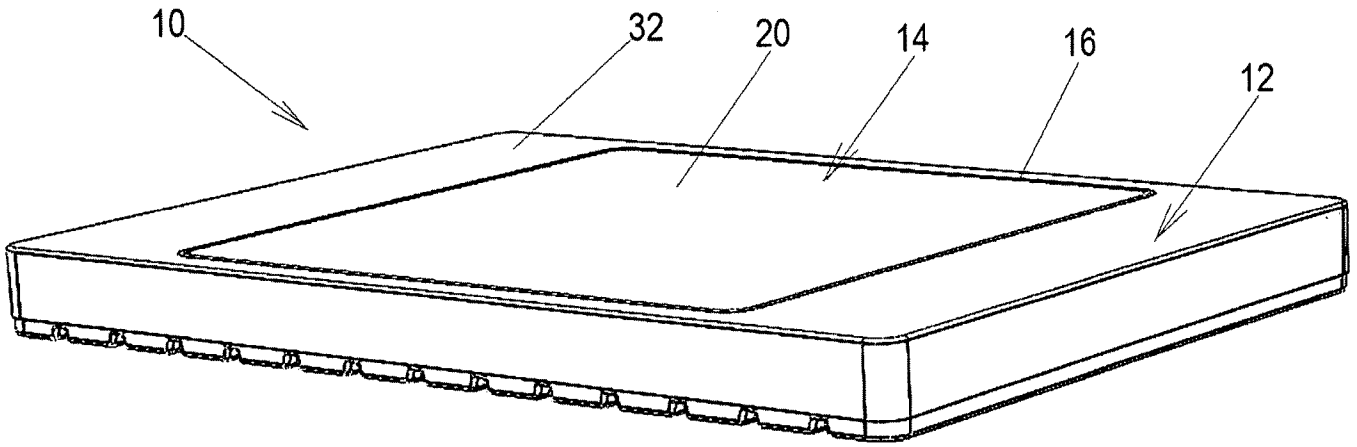
FIG. 1 is a perspective view of a driving practice assembly in accordance with the present invention.

FIG. 1 shows a practice golf driving surface assembly 10 in accordance with the present invention, the two principal parts of the assembly being a base 12 and a driving surface insert 14 removably installed within a recess 16 in the base.

Figure 2:
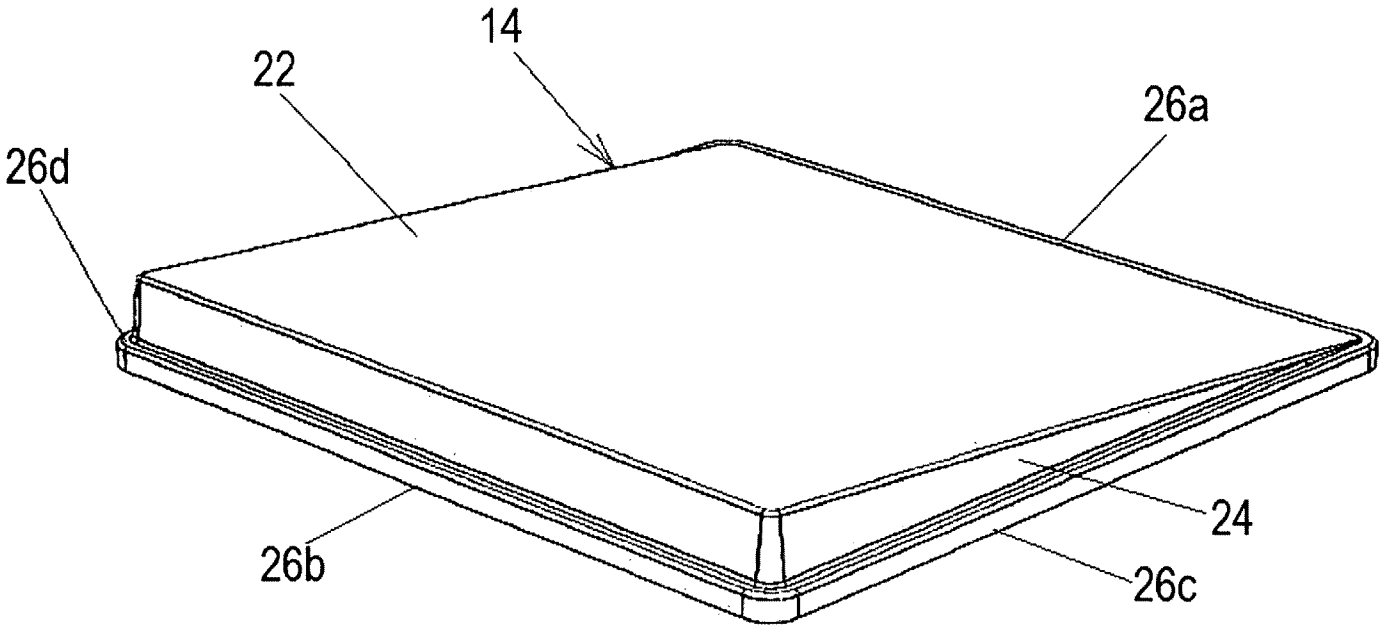
FIG. 2 is a top perspective view of the removable driving surface insert of the assembly of FIG. 1, showing the insert with a raised, angled surface thereof disposed upwardly.

As can be seen with further reference to FIG. 1 and also FIG. 2, the driving surface insert 14 of the illustrated embodiment includes a generally horizontal surface 20 and a generally sloped surface 22, on opposite sides of a somewhat plate-like body 24 having outer edges 26*a-d*. The driving surfaces are preferably sized large enough that the player may stand entirely atop the surface when driving, with dimensions of about 36-60 inches square being generally suitable and about 42 inches square being preferred. It will also be understood that inserts having shapes other than square may be employed in some embodiments, such as rectangular, polygonal, circular, oval or irregular, for example.

Figure 3:
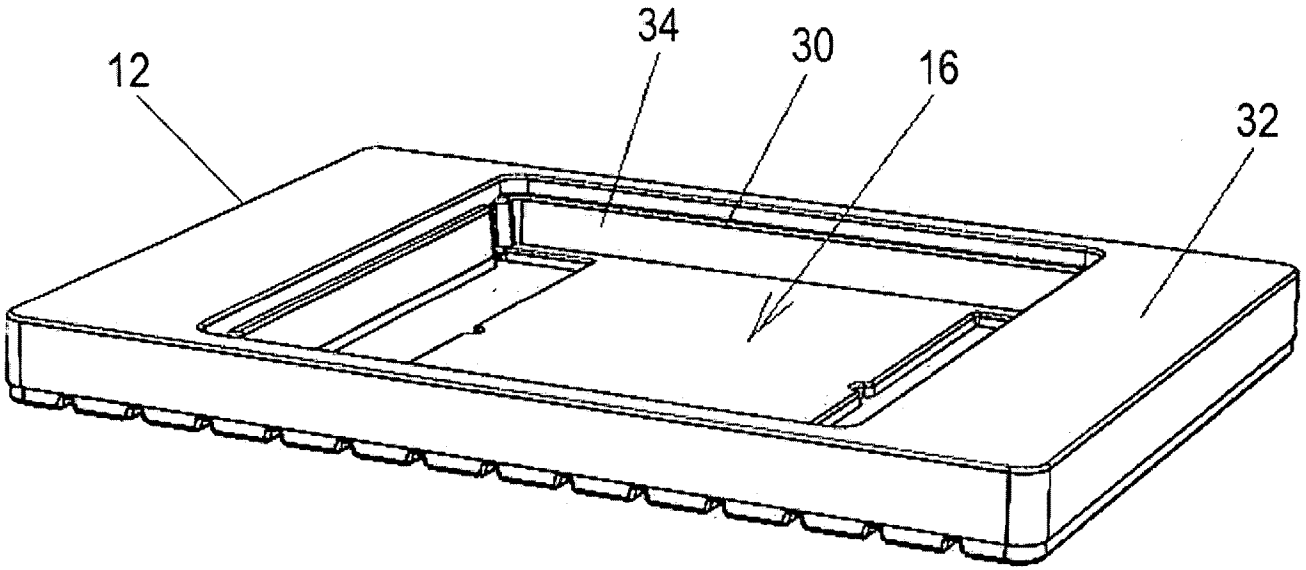
FIG. 3 is a perspective view of the base of the driving surface assembly of FIG. 1, showing the recess in the upper side of the base member that receives the removable insert having the driving surfaces.

Referring to FIG. 3, it can be seen that the recess 16 in base 12 is dimensioned to receive the driving surface insert 14 with either surface 20, 22 disposed upwardly, with the edges of the recess and insert being in close conformity and a lip of the insert being supported atop a stepped shoulder 30 formed about the perimeter of the recess. The shoulder 30 is set below a horizontal upper surface 32 of the base by a height that is approximately equal to that of the edges 26*a-d* of the insert, such that the horizontal surface 20 of the insert will lie substantially level and flush with the surface 32 of the base when the former is disposed upwardly and the insert is installed in recess. The depth of the well below shoulder 30, as defined by the side walls 34 of recess 16, is in turn sufficient to accommodate the angled surface 22 of the insert when disposed downwardly therein.

Figure 4:
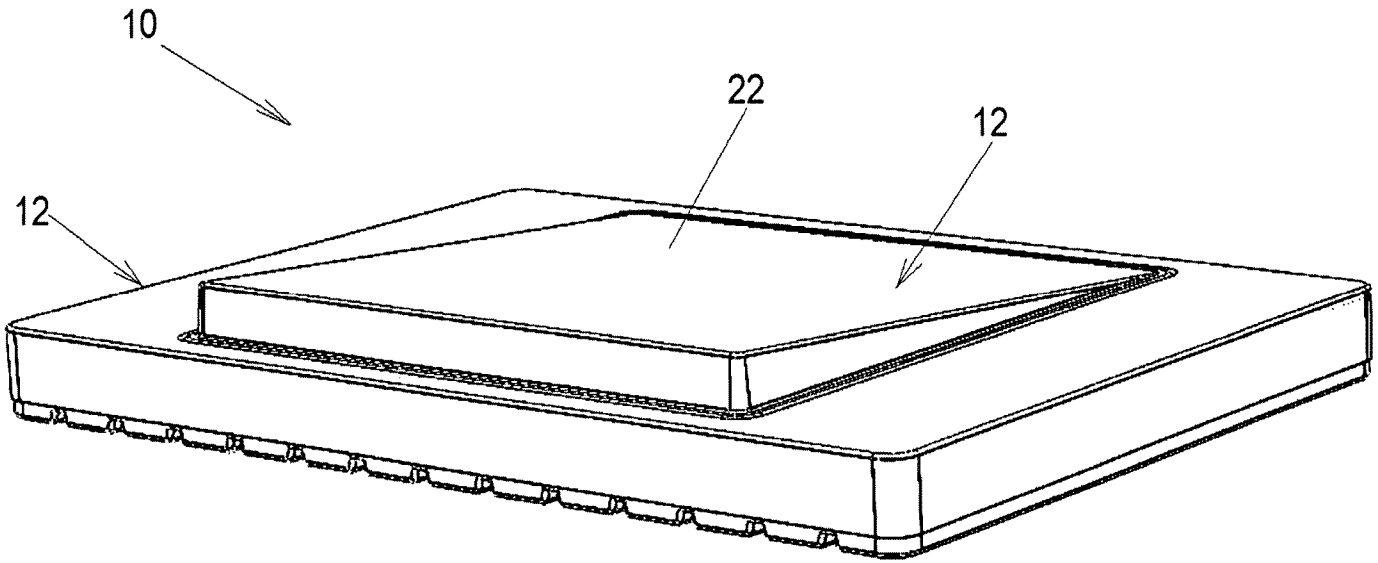
FIG. 4 is a perspective, partially ghosted view of the practice assembly of FIG. 1, showing the driving surface insert placed in the recess of the base with the sloped surface of the former disposed upwardly.

Thus, when insert 14 is installed in the recess 16 of the base as shown in FIG. 1, the horizontal surface 20 of the insert and the surrounding surface 32 of the base cooperate to form a substantially continuous surface on which the golfer can practice driving from a horizontal tee. Then, to change from this configuration, the insert 14 may be removed from the base, inverted, and then replaced the recess with the angled surface 22 disposed upwardly, as shown in FIG. 4, to permit the golfer to practice driving from a sloped lie, as commonly is the case on an actual fairway. Moreover, the insert can be rotated about the vertical axis and replaced in the recess, at 90° intervals in the square configuration that is illustrated, so that the golfer is able to practice with the surface angled in different directions, e.g., left and right and uphill and downhill.

The driving surfaces 20, 22 of the insert member 14 may be provided with a layer of synthetic turf material that forms the actual driving surface, preferably over a cushioning substrate. For the reasons noted above the synthetic turf material will tend to wear during the course of normal use, however, as compared with prior approaches the present invention permits renewal to be effected much more efficiently, by simply removing the insert member and replacing it with another member having fresh surfaces; in this manner, the individual driving station need not be taken out of service and the inserts having worn turf surfaces can be recovered at a convenient time and location; furthermore, the layers of artificial turf may be mounted to the surfaces of the insert members in a manner that allows them to be quickly removed and replaced with minimal time and effort, for example, employing hook-and-loop fabric or a quick-release adhesive in conjunction with precut panels of turf material.

It will be understood that in some embodiments one or the other of the surfaces of the insert may be surfaced with a different material, such as elastomeric material simulating soil surface, or may be left bare, or may include a tray or other structure for holding sand or other soil for practicing driving from a trap or the rough. It will also be understood that not all inserts may be two-sided, and that not all may include both angled and horizontal surfaces; for example, the insert may have horizontal surfaces on both sides, one covered with a shorter turf and the other with a longer turf, to allow a golfer to practice with different turf conditions as may be expected on an actual course. Furthermore, the surfaces may be contoured and/or have surface features rather than being planar as in the illustrated embodiment.

Having provided an overview of the assembly and its operation, the structure of the components will be described in greater detail below.

Figure 5:
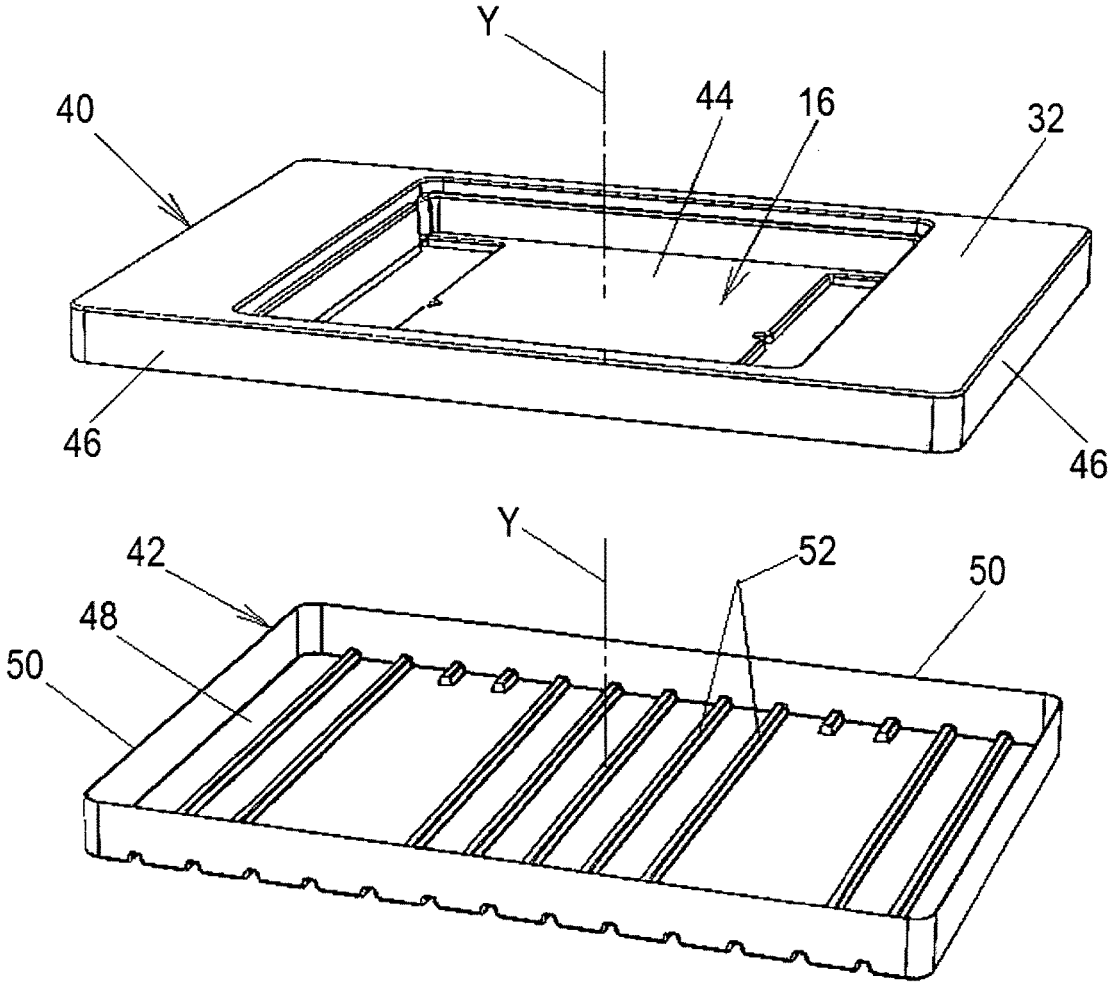
FIG. 5 is a perspective, exploded view of the base member of FIGS. 1 and 3, showing the top panel and tray that are joined together to form the exterior of the base.

In the preferred embodiment that is illustrated, both the base and insert employ a foam core construction in which rigid upper and lower shell pieces sandwich a layer of foam material. As can be seen in FIG. 5, the shell pieces of the base include an upper deck section 40 and a lower tray section 42, both of which are suitably molded of plastic sheet material. The upper side of the deck section forms the horizontal upper surface 32, with the recess 16 being formed therein and including a bottom panel 44. The outer edges of the deck section include depending flange portions 46 that form the outer walls of the edges of the base member. The tray section 42 in turn includes a bottom wall 48 having upwardly projecting flange portions 50 about its perimeter, that fits within the depending flanges 46 of the upper deck section 40. Transverse ribs 52 molded in the bottom panel 48 impart increased rigidity to the base section.

Figure 6:
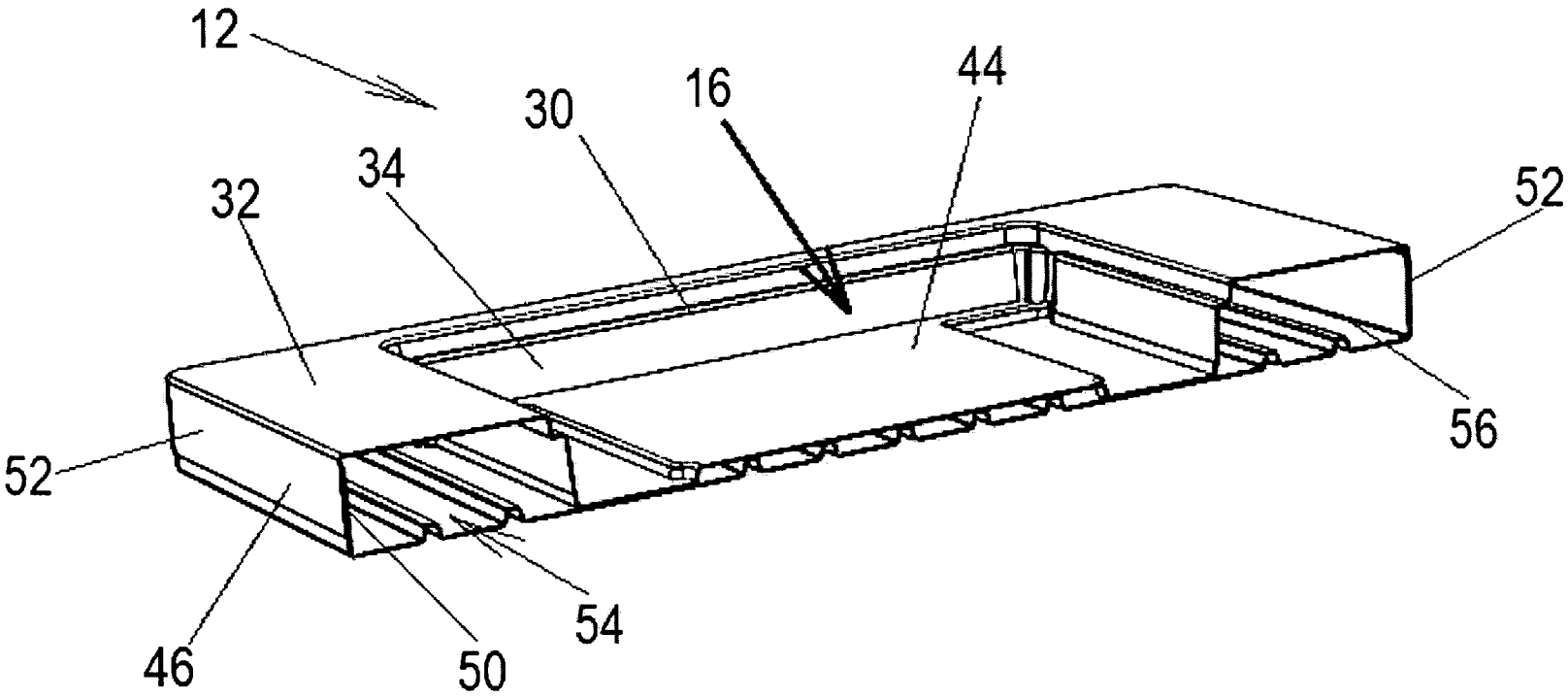
FIG. 6 is a cross-sectional view of the base member of FIGS. 1 and 3, showing the foam filled core that is sandwiched between the tray and top panel when assembled.

To assemble the base 12, the top panel and tray sections 40, 42 are aligned along a common vertical axis "Y," and then slipped together with the flange portions 50 of the tray section fitting inside the flange portions 46 of the deck section as shown in FIG. 6, so as to form a double thickness edge 52 about the perimeter of the base. The interior cavity 54 is filled with a foam material 56, preferably a closed-cell foam material, forming a strong yet lightweight structure.

Figure 7:
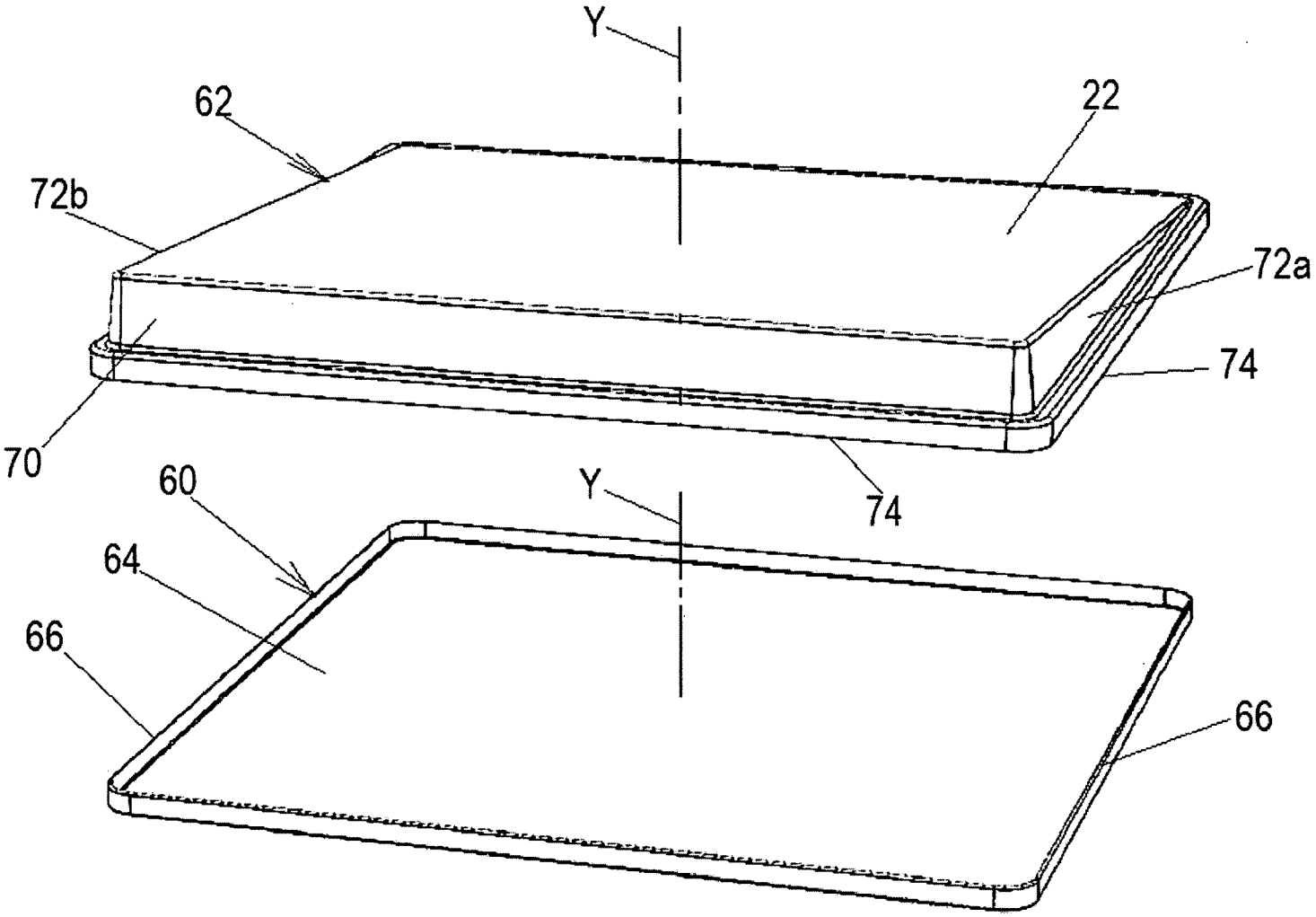
FIG. 7 is a perspective, exploded view of the driving surface insert of FIGS. 1 and 2, showing the first and second panels that are joined together to form the two-sided insert.
Figure 8:
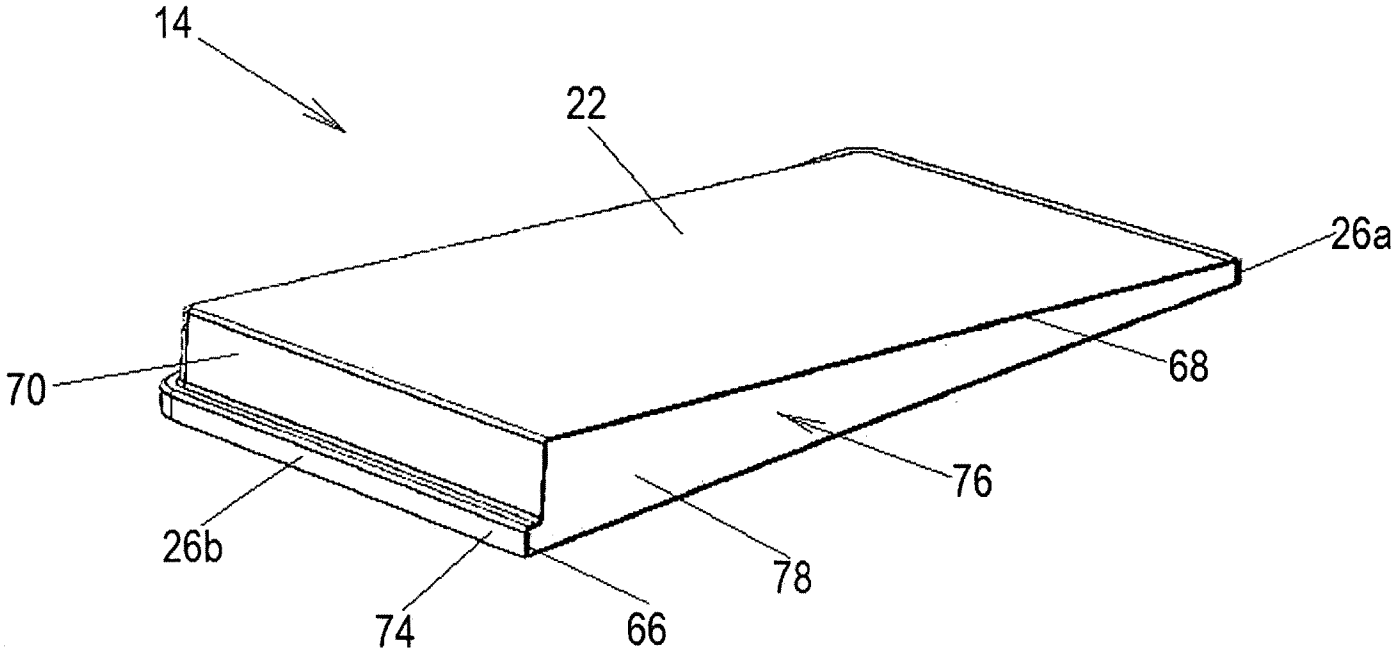
FIG. 8 is a perspective, cross-sectional view of the driving surface insert of FIGS. 1 and 2, showing the foam filled core that is sandwiched between the upper and lower panels when assembled.

As can be seen in FIGS. 7-8, insert 14 is similarly constructed, with the shell being formed by first and second sections 60, 62. The first shell section 62 includes a panel-shaped wall 64, the outer surface of which forms the flat, horizontal driving surface 20 when disposed upwardly, bordered by an upwardly projecting flange portion 66. The second shell section 62, in turn, includes a panel-shaped wall 68 (see FIG. 8) that forms the sloped driving surface 22, with raised and wedge-shaped walls 70 and 72*a-b* on three sides. A depending flange portion 74 about the outer edge of the angled-surface shell section 62 forms the outer wall of the edges of the insert.

To assemble the insert 14, the first and second shell sections 60, 62 are aligned along the common vertical axis "Y" and pressed together, with flange portion 66 fitting inside flange portion 74 to form the double thickness edges 26*a-d* about the perimeter of the insert member as shown in FIG. 8. The cavity 76 between the shell sections is filled with a foam material, again preferably a closed-cell foam material, to form a lightweight yet rigid and sturdy structure.

Figure 9:
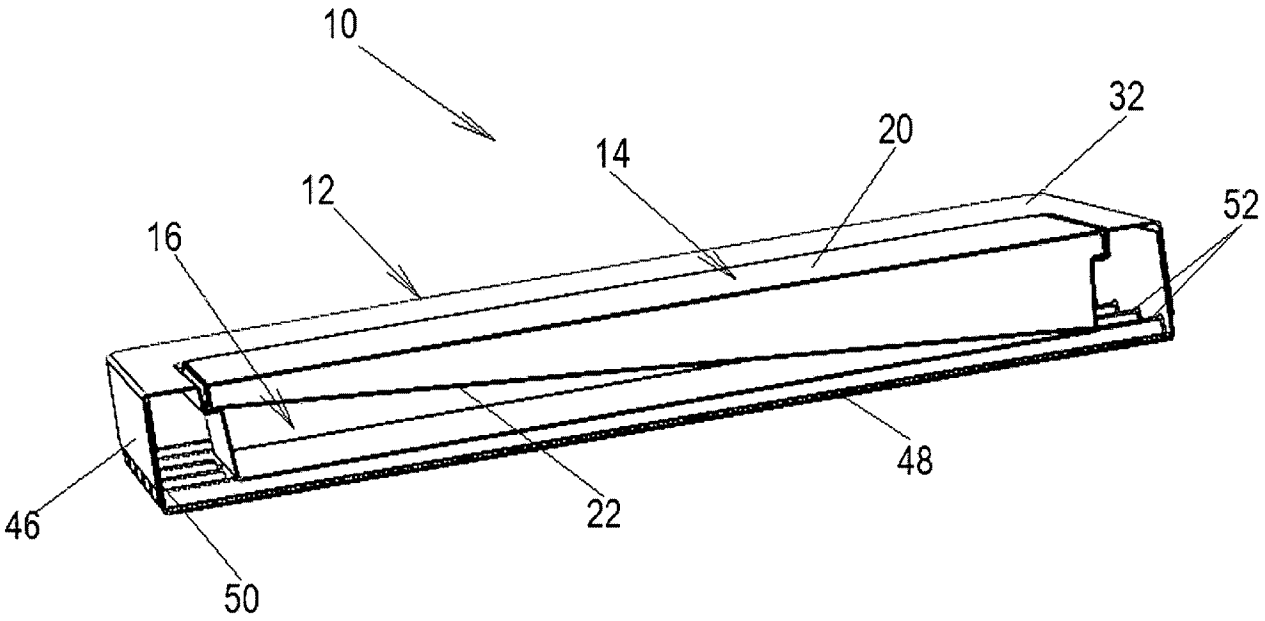
FIG. 9 is a perspective, cross-sectional view of the practice assembly of FIG. 1, showing the manner in which the raised, angled surface of the insert member is accommodated by the recess in the base when the insert is placed in the base with the flat, horizontal surface disposed upwardly.
Figure 10:
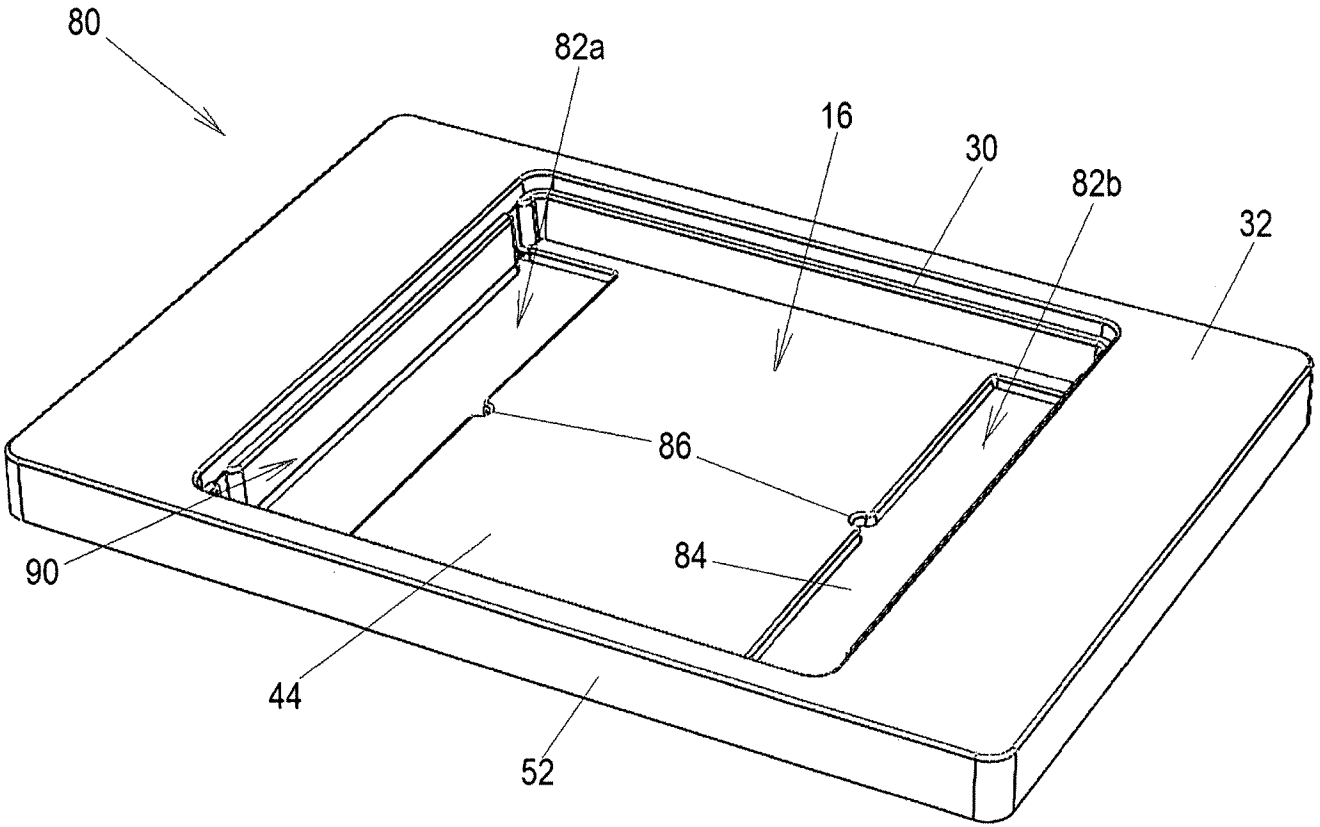
FIG. 10 is a perspective view of a base member of a practice assembly in accordance with a second embodiment of the invention, in which the pitch of the driving surface insert is adjustable employing a series of "flip-up" supports located within the recess of the base member.

Thus constructed, the base member and insert member cooperate in the manner described above and as is also shown in the cross-sectional view of FIG. 9. Assemblies 10 may be employed individually or in groups, for example, a series of the base members may be mounted or linked in side-by-side relationship to form a row of practice stations in a driving range. Furthermore, the assemblies may be installed on top of a concrete slab or other substrate, or may be set within a substrate or below grade in some instances, or may be cast or otherwise formed in the concrete or other substrate itself rather than being a separate component. Still further, the insert member may in some instances be placed upon an existing surface or used separately without the base member.

FIGS. 10-13 show a base 80 in accordance with a second embodiment of the invention, in which the pitch of the flat/sloped surfaces of the insert is adjustable. The overall structure of base 80 is similar to that described above, with like reference numerals being used for like features and structures thereof.

As with the embodiment described above, base 80 includes a recess 16 set within its upper surface 32, that receives the insert having the driving surfaces. However, additional shallow wells 82*a*, 82*b* are set within the bottom 34 of the main recess, each having a bottom wall 84 and a notch 86 along the inboard edge. Flip-up pitch adjustment assemblies 90 are mounted within the two wells 82*a*, 82*b*, one assembly 90 only being shown in FIG. 10 for ease of illustration.

Figure 11:
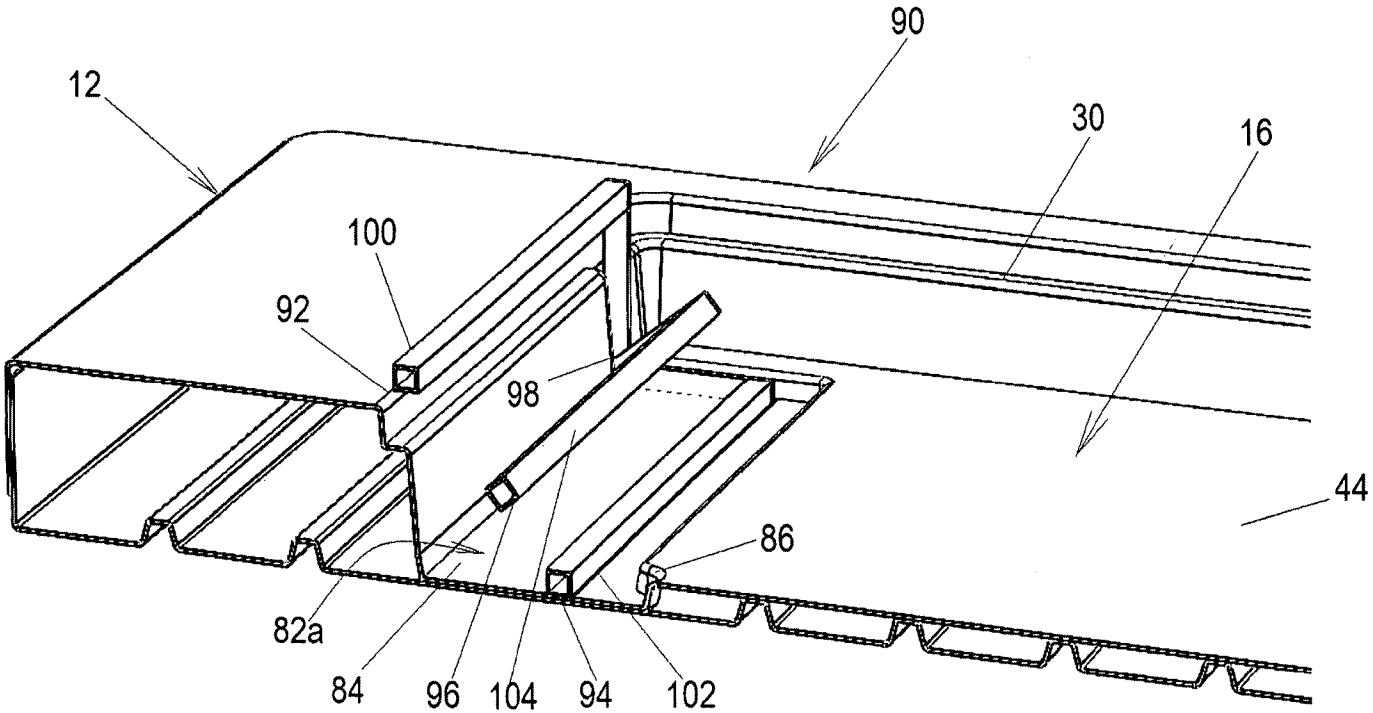
FIG. 11 is an enlarged perspective, partial cross-sectional view of the recess and the "flip-up" supports of the base member of FIG. 10, showing the manner in which the individual supports have different heights so as to adjust the insert to different angles depending on which of the supports is raised.
Figure 12:
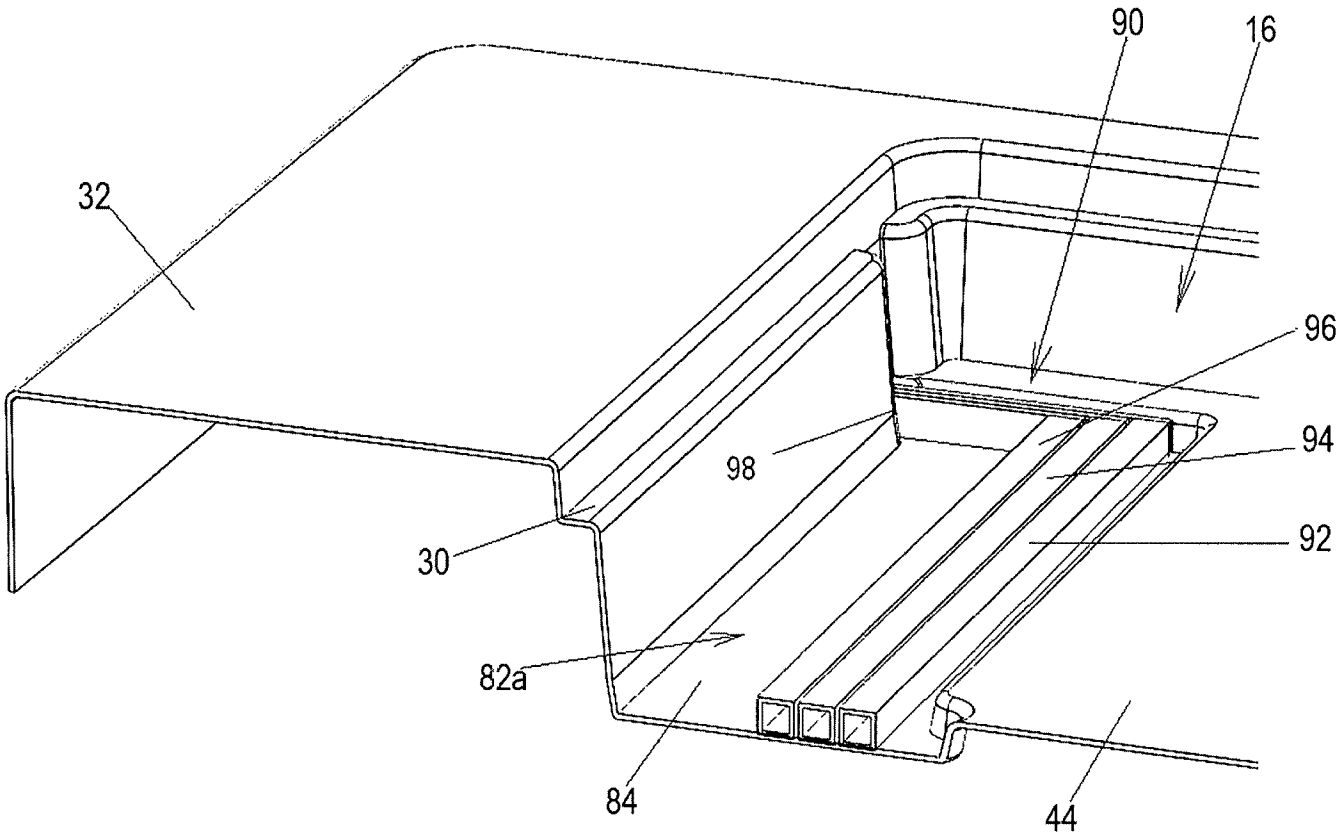
FIG. 12 is a second perspective, partial cross-sectional view of the recess and supports the base member of FIG. 10, showing the supports lowered and nested within the bottom of the recess when not in use.
Figure 13:
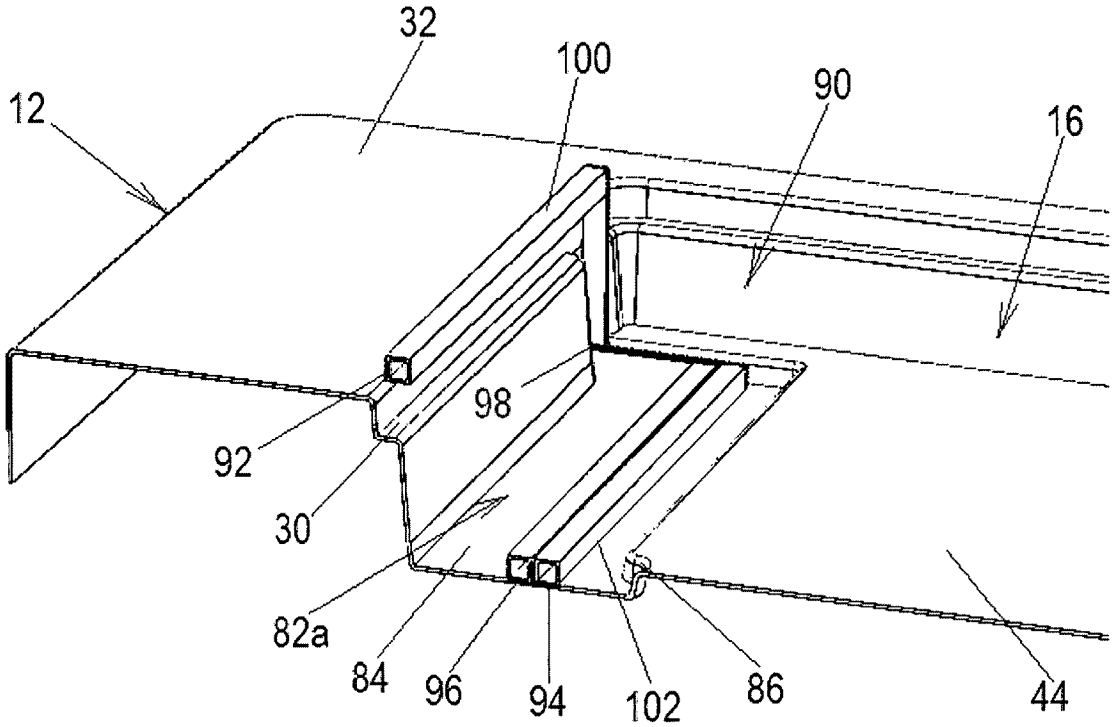
FIG. 13 is a third perspective, partial cross-sectional view of the supports and recess of the base member of FIG. 10, illustrating a selected one of the supports pivoted to a raised orientation so as to support the driving surface insert at an increased angle relative to the base of the assembly.

As can be seen in FIGS. 11-13, each of the pitch adjustment assemblies 90 includes a series of U-shaped bars 92, 94, 96, having legs mounted to horizontal pivot connections 98 at the sides of the recess and upper surfaces 100, 102, 104 that extend horizontally when the bars are pivoted to an upright orientation. The illustrated embodiment includes three flip-up bars, however, it will be understood that a lesser or greater number of bar members may be employed. The legs of the bar members are of different lengths so that the upper surfaces will be at different heights when erected. When not in use, the bar members fold down and nest within the wells 82*a*, 82*b* and lie flat against the bottom wall 84 of the latter, so as to be flush with or below the bottom wall 44 of the main recess; in this position the flip-down bars are out of the way and do not interfere with the insert 14 being placed in the recess with the sloped surface disposed downwardly, in the manner shown in FIG. 9, with the lip of the insert resting on shoulder 30 and horizontal surface 20 flush and level with the upper surface 32 of the base.

To adjust the slope of the surface, the user flips a selected one of the bars up to an erected configuration, by inserting a finger in notch 86 and rotating the bar about pivot connections 98. For example, FIG. 13 shows the tallest bar 92 flipped up to the erect position so that a lip of the insert may be set atop the elevated surface 100; this may be done with either the horizontal or sloped surface of the insert disposed upwardly. To achieve a reduced pitch, bar 100 may be flipped back down into the well 82*a* and the intermediate height bar 94 or the low bar 96 raised in its place. If all bars are lowered, the lip of the insert rests atop the shoulder 30 of the recess in the manner described above.

The embodiment illustrated in FIGS. 10-13 includes pitch adjustment assemblies at both ends of the base member. It will be understood that in some instances a pitch adjustment assembly may be included at only one end, or additional assemblies may be included along the sides, and further more instances the adjustment mechanism may be mounted on the insert member rather than the recess or with part of the mechanism on both. It will also be understood that other forms of pitch adjustment mechanisms may be incorporated in addition to or in place of that illustrated, including gears, screws, jacks, wedges, levers, and other manually, mechanically, electrically and hydraulically operated mechanisms, for example.

It will be understood that the scope of the appended claims should not be limited by particular embodiments set forth herein, but should be construed in a manner consistent with the specification as a whole.

What is claimed is:

1. A golf driving practice assembly, comprising:

a base, comprising:

a downwardly extending recess; and an insert having first and second sides that is removably receivable in said recess of said base, said insert comprising:

a generally flat driving surface on said first side of said insert, that extends horizontally when said insert is received within said recess of said base with said first side disposed upwardly; and a generally sloped driving surface on said second side of said insert, that extends at an angle when said insert is received within said recess of said base with said second side disposed upwardly.

2. The driving practice assembly of claim 1, wherein said base comprises:

an upper surface that lies generally level and flush with said flat driving surface of said insert when said insert is received within said recess with said first side disposed upwardly.

3. The driving practice assembly of claim 2, wherein said, generally sloped driving surface on said second side of said insert extends above said surface of said base when said insert is received within said recess with said second side disposed upwardly.

4. The driving practice assembly of claim 3, wherein said recess of said base comprises:

a shoulder that supports a lip of said insert when said insert is received within said recess with either of said first or second sides of said insert disposed upwardly.

5. A golf driving practice assembly, comprising:

a base, comprising:

an upper surface;

a recess extending downwardly from said upper surface; and an insert member, comprising:

a body that is invertably receivable in said recess of said base;

a first substantially flat surface on a first side of said body that extends substantially flush with said playing surface of said base when said insert member is received in said recess with said first side thereof disposed upwardly; and a substantially sloped surface on a second side of said body that extends upwardly at an angle above said playing surface of said base when said insert member is received in said recess with said second side thereof disposed upwardly.

6. A golf driving practice assembly, comprising:

a base, comprising:

an upper surface;

a recess extending downwardly from said playing surface; and an insert member, comprising:

a body that is receivable in said recess in said base;

at least one driving surface formed on said body that faces upwardly when said body is received in said recess; and at least one adjustable support that is operative to raise an edge of said insert within said recess, from a first position in which said driving surface of said insert member extends substantially flush with said upper surface of said base, to a raised position in which said driving surface of said insert member extends at an angled slope above said upper surface of said base.

7. A golf driving practice assembly, comprising:

a base comprising:

a shell, comprising:

a top panel forming an upper side of said base, said upper side of said base having a downwardly extending recess formed therein; and a tray that receives said top panel with a cavity being formed between said top panel and said tray; and an insert that is removably receivable in said recess in said upper side of said base, said insert comprising:

a first, generally flat driving surface that extends horizontally when said insert is received within said recess of said base member;

said upper surface of said base member lying generally level and flush with said flat driving surface of said insert member when said insert member is received within said recess with said flat driving surface disposed upwardly with said flat driving surface disposed upwardly.

8. The driving practice assembly of claim 7, wherein said base further comprises:

foam fill material installed in said cavity between said top panel and said tray of said shell.

9. The driving practice assembly of claim 8, wherein said top panel and said tray are formed of molded plastic sheet material.

10. A golf driving practice assembly, comprising:

a base comprising:

an upper surface; and a downwardly extending recess; and an insert that is removably receivable in said recess of said base and that has an outer edge that fits closely within an inner edge of said recess, said insert comprising:

a shell, comprising:

a first panel having a first, generally flat driving surface formed thereon that extends horizontally and lies generally level and flush with said upper surface of said base when said insert is received within said recess of said base with said flat driving surface disposed upwardly;

a second panel having a second, generally raised driving surface formed thereon that extends above said upper surface of said base when said insert is received within said recess of said base with said raised driving surface disposed upwardly; and a cavity formed in said shell between said first and second panels.

11. The driving practice assembly of claim 10, wherein said insert further comprises:

foam fill material installed in said cavity between said first and second panels of said shell of said insert.

12. A golf driving practice assembly, comprising:

a base, comprising:

a downwardly extending recess;

an insert that is removably receivable in said recess of said base, said insert comprising:

a first, generally flat driving surface that extends horizontally when disposed upwardly with said insert received within said recess of said base; and a height adjustment mechanism operable to vary a pitch of said insert member within said recess.

13. The driving practice assembly of claim 12, wherein said height adjustment mechanism comprises:

at least one bar member that is mounted within said recess of said base that is pivotable from a lowered position to a raised position in which said bar member supports an edge of said insert member at a raised elevation.

14. The driving practice assembly of claim 13, wherein said bar member comprises:

an inverted U-shaped bar member having first and second legs that are pivotably mounted to said base member and a generally horizontal upper rung that supports said edge of said insert member.

15. The driving practice assembly of claim 1, wherein said at least one bar member comprises:

a plurality of bar members having different heights.

16. The driving practice assembly of claim 15, wherein said plurality of bar members having different heights comprises:

a plurality of bar members that nest within one another when folded to a bottom of said recess.

* * * * *